United States Patent [19]

Larson

[11] Patent Number: 4,771,977

[45] Date of Patent: Sep. 20, 1988

[54] BOOK SUPPORT

[76] Inventor: Leslie N. Larson, P.O. Box 397, Mabel, Minn. 55954

[21] Appl. No.: 72,105

[22] Filed: Jul. 10, 1987

[51] Int. Cl.[4] ..... A47B 97/04

[52] U.S. Cl. ..... 248/460; 248/446; 248/447; 248/454

[58] Field of Search ..... 248/460, 462, 465, 446, 248/447, 448, 458, 454, 441.1, 479; 211/199, 198

[56] References Cited

U.S. PATENT DOCUMENTS

| | | | |
|---|---|---|---|
| 3,076,285 | 2/1963 | Sparkman | 248/448 |
| 3,376,009 | 4/1968 | Domino | 248/460 X |
| 4,116,413 | 9/1978 | Andersen | 248/460 X |
| 4,150,807 | 4/1979 | Manso | 248/460 X |
| 4,436,271 | 3/1984 | Manso | 248/460 |
| 4,460,146 | 7/1984 | Raggiotti | 248/460 X |
| 4,512,542 | 4/1985 | Black | 248/460 |

*Primary Examiner*—Ramon O. Ramirez
*Attorney, Agent, or Firm*—Lawrence M. Nawrocki

[57] ABSTRACT

A book support having a pillar with a facing surface against which the binding of a book to be supported rests. The angle of said facing surface can be oriented at a desired angle relative to a surface on which the support rests. The binding rest also comprises variable angle wings which are disposed for pivoting about generally vertical axes.

16 Claims, 3 Drawing Sheets

BOOK SUPPORT

TECHNICAL FIELD

The present invention relates broadly to support structures. More narrowly, however, the present invention deals with such a structure which is employed to support a book while it is being read. A preferred embodiment of the invention is direct to such a structure wherein the book can not only be supported, but wherein pages of the book can be held open so that the reader's hands can be completely free.

BACKGROUND OF THE INVENTION

Certainly, reading is one of the favorite pastimes of people all over the world. The scope of literary content which interests people varies from subject matter such as exciting, fast-paced spy novels to the Bible.

Almost as varied as is literary subject matter is the plethora of times when, and locations where, people read. For example, certain individuals have jobs such as night watchmen in which, while rounds have to be made at intervals, they are free, between rounds, to dedicate their time to their current reading project. Even if an individual is not able to read while actually on the job, the employee can engage in reading during breaks and lunch time.

In the home, virtually every room can be, and is, utilized for reading. Certainly, the living room and family room are two areas of a house which are particularly utilized for this purpose.

The bedroom is another location that is probably as common, if not more common, for reading. Many individuals enjoy studying the Bible or reading from a novel before going to sleep.

Regardless of the location where one reads, however, although the problem is particularly acute in the bedroom, circumstances can dictate that reading would be facilitated if a convenient to use and easily assemblable and disassemblable book support were available. Such a support could well enable the hands of the reader to be freed-up for taking notes, performing unrelated chores, etc.

Optimally, such a support would be light in weight, able to be easily assembled, and able to be readily disassembled for storage. Additionally, it would be stable, yet be able to be adjusted so that the book supported thereby could be inclined at an appropriate angle. Finally, an additional desirable feature which would be incorporated is one wherein the book could be maintained open to a particular page to further free-up the hands of the reader.

It is to the satisfaction of these desirable features dictated by the prior art that the present invention is directed. It is an improved book support which is not only practical, but is also simple and economical.

SUMMARY OF THE INVENTION

The present invention is a book support which includes a pillar having a forwardly facing surface against which the binding of a book to be supported rests. Means are provided for orienting the binding rest pillar at a desired angle relative to a surface on which the support is positioned. The binding rest carries at least a pair of wings which are engaged by the front and back covers of the book and which constrain those covers to positions beyond which they cannot be moved. The wings are disposed for pivoting about generally parallel axes. Finally, the support includes an element, typically associated with the binding rest pillar, which underlies the book to be supported. The structure thusly configured provides that, when a book is seated on the underlying means, the binding of the book will be in engagement with the binding rest.

As previously indicated, in a preferred embodiment, the binding rest has a forwardly facing surface which is engaged by the book's binding. In that embodiment, tabs intersect a main body portion of the rest defining this forwardly facing surface, the tabs extending rearwardly from the main body portion of the rest. It is envisioned that the tabs would intersect the main body portion so that planes defined thereby would be parallel to each other and generally perpendicular to a plane defined by the main body portion.

In one manner of constructing the support, each tab carries a pair of tangs, and one tang carried by each tab is axially aligned with a tang carried by the other tab. The variable angle wings can be configured in a generally U-shape, distal ends of each of the legs being provided with registered apertures. Each of two wings can, thereby, be fitted on two corresponding tangs, at least one of the legs of the wing being resilient so that the legs of the wing can be urged inwardly toward one another to permit the wing to be brought between corresponding, aligned tangs, and thereafter, released to permit the tangs to enter the apertures in the legs. The corresponding tangs, thereby, define an axis about which its related wing pivots.

In one embodiment, a shelf can be provided to underly and hold the book to be supported. The relationship between the wings and the binding rest can be such that the wings can be pivoted to extend, in some measure, forward of the forwardly facing surface of the binding rest. The shelf can be sized and shaped so that it can be fitted between, at its front edge, interconnecting braces of the wings and, at its rear edge, the forwardly facing surface of the binding rest. The shelf can be vertically disposed so that it is seated on the lower legs of the wings.

In the preferred embodiment, at least one generally U-shaped member can be employed to orient the binding rest at the desired angle. The member can be configured similarly to the variable angle wings supporting the front and back covers of the book carried by the apparatus.

As in the case of the wings, distal ends of legs of the member can be provided with apertures, and the legs can be spaced from one another such that the element can be fitted on two corresponding tangs extending from the binding rest tabs. Typically, two such elements would be provided, one being associated with each of the two groups of corresponding tangs.

The orienting elements, in order to maintain the binding rest at a desired angle, would be made to extend generally rearwardly from the rest. They would, of course, as would be true in the case of the book cover support wings, be able to be pivoted about an axis defined by their associated tangs, and, as will be able to be seen, the angle at which the binding rest is maintained will vary as pivoting of the orienting elements is effected.

Additionally, the angles at which leg portions of the generally U-shaped member intersect a base portion of the member can be different. The member or members can, thereby, be inverted with respect to the binding rest to vary the angle at which the binding rest is oriented.

The present invention is thus an improved book support which solves many of the problems of the prior art and incorporates many advantageous features dictated by the prior art. More specific description of those features and advantages obtained in view of provision of those features will become apparent with reference to the DETAILED DESCRIPTION OF THE INVENTION, appended claims, and accompanying drawing figures.

BRIEF DESCRIPTION OF THE DRAWING FIGURES

DETAILED DESCRIPTION OF THE INVENTION

Figure 1:
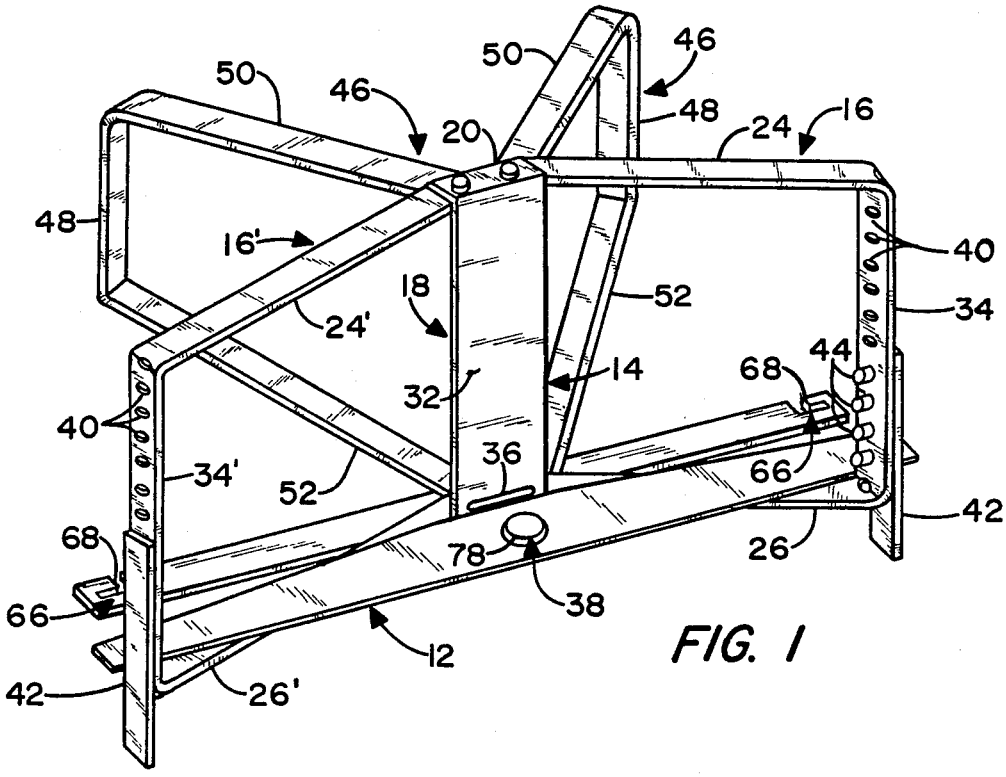
FIG. 1 is a perspective view of a preferred embodiment of the invention.
Figure 2:
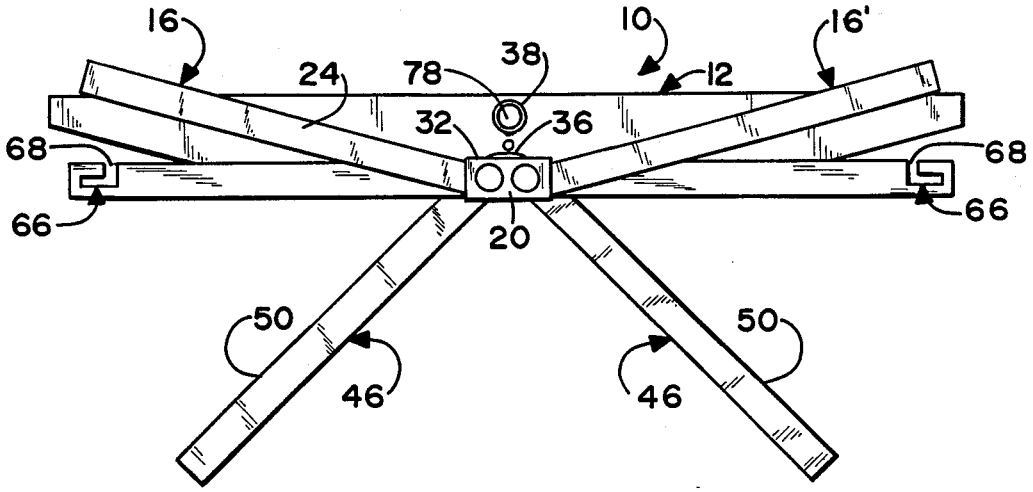
FIG. 2 is a top plan view of the embodiment illustrated in FIG. 1.
Figure 3:
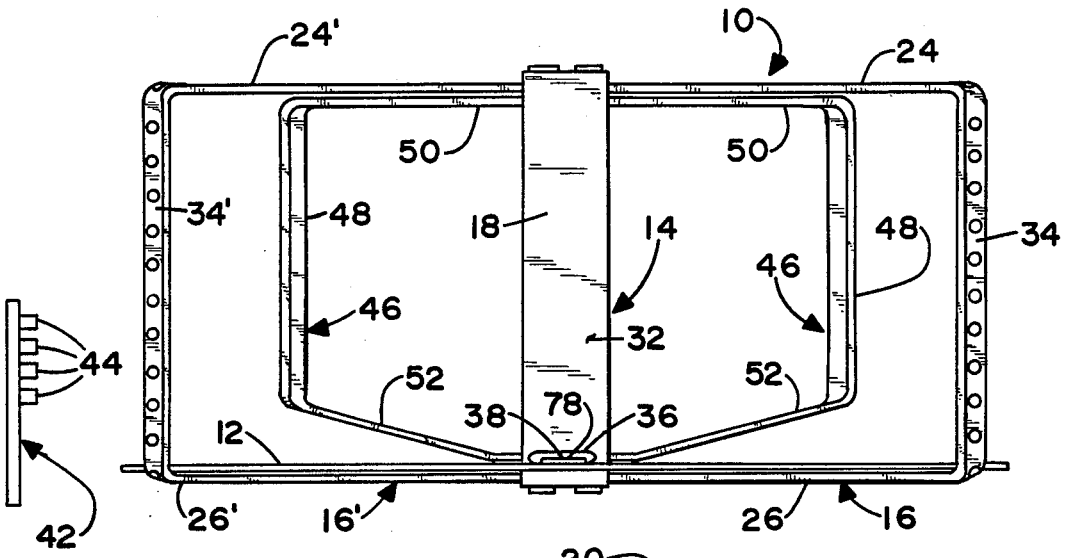
FIG. 3 is a front elevational view of the embodiment illustrated in FIG. 1, a support leg being illustrated in an exploded fashion.

Referring now to the drawings wherein like reference numerals denote like elements throughout the several views, FIG. 1 illustrates a preferred embodiment of the invention. That embodiment will be described with reference not only to FIG. 1, but also with reference to FIGS. 2, 3, and 4.

The book support 10 illustrated in those figures includes a generally horizontal support structure and a generally vertical support structure. The generally horizontal support structure comprises a shelf 12 which, in the embodiment illustrated, is hexagonal in shape. The shelf 12 is, substantially, an isosceles triangle which is truncated at each of its apexes so that the side formed by truncating the angle which is not equal to the other two angles is parallel to the opposite side of the figure, and so that the sides formed by truncating the equal angles are parallel to one another.

The vertical support structure includes a pillar-like member 14 which, when a book (not shown) is seated on the shelf 12, is engaged by the book's binding. Additionally, the vertical support structure includes, as illustrated in the figures, a pair of generally U-shaped, variable angle wings 16,16' which are carried by the pillar-like binding rest 14.

The binding rest 14 is unitarily formed from a strap having ends which are angled, with respect to a main body portion 18 of the rest 14, generally at 90°. A pair of tabs 20,20' are, thereby, formed. Each tab 20,20', in turn, is provided with a pair of tangs 22,22' which extend, from their associated tab 20,20', toward the opposite tab and its associated tangs. Each tang 22,22' is axially aligned with a corresponding tang carried by the opposite tab. An axis of rotation for each of the variable angle wings 16,16' is, thereby, defined.

The tangs 22,22' can be formed in any appropriate manner. It is envisioned, however, that they can take the form of rivets, when the support 10 in accordance with the invention is made of metal, received in associated apertures in the tabs 20,20'. When rivets are employed, they can be welded or secured to their associated tabs 20,20' in any appropriate manner. When the support is made of plastic or other similar material, the tangs 22,22' can be integrally molded with the binding rest 14 and its tabs 20,20'.

The wings 16,16' can be constructed of a material or materials such that at least one of the upper and lower legs 24,24',26,26' can be flexed. Spacing between these legs is slightly less than the distance between the tabs 20,20' of the binding rest 14, and flexure of the one or more legs allows the legs of a wing 16,16' to be brought together toward one another sufficiently so that they can be fitted between innermost extremities of corresponding tangs 22,22' and, thereafter, released so that the tangs 22,22' can enter apertures 28,28',30,30' formed in the distal ends of the legs 24,24',26,26' of the wings 16,16'. When the legs are permitted to expand outwardly, they become retained on the tangs, and they are able to pivot relative thereto.

As best seen in FIG. 1, the locations of the tangs 22,22' relative to their associated tabs 20,20' is such that the wings 16,16' are able to pivot forward of a plane defined by the forwardly facing surface 32 of the main body portion 18 of the binding rest 14. The construction of the shelf 12 is such that it can be wedged between the forwardly facing surface 32 of the main body portion 18 of the binding rest 14 and braces 34,34' interconnecting the opposed upper and lower legs 24,24',26,26' of the U-shaped wings 16,16'. The shelf 12 can be urged downwardly so that it becomes seated on the lower legs 26,26' of the wings 16,16'. A bead 36 can be provided on the forwardly facing surface 32 of the main body portion 18 of the binding rest 14 at a location so that, when the shelf 12 is seated on the lower legs 26,26', the bead 36 will engage the upper surface of the shelf 12 to hold the shelf 12 in position.

As seen in the figures, an eccentric 38 can be pivotly mounted centrally on the shelf 12. This eccentric 38 extends upwardly from the upper surface of the shelf 12 sufficiently so that, when a book is supported on the shelf 12, the eccentric 38 will maintain the pages separated at an appropriated location in the book and hold those pages open so that the reader can read without having to hold the book manually.

In order to afford stability to the support invention in accordance with this document, three or four point contact can be provided. The interconnecting braces 34,34' of the wings 16,16' can be provided with a plurality of apertures 40 spaced along an axis of each brace 34,34'. Extension legs 42 having a plurality of pegs 44 extending from one side thereof can be mated with corresponding braces by inserting the pegs 44 through the apertures 40 in the braces 34,34', the spacing between the pegs 44 being substantially the same as that between the apertures 40. It will be understood, of course, in view of this disclosure, that the size and shape of the apertures 40 would be closely proximate that of the pegs 44.

Rear support can be provided by one or more generally U-shaped members 46. These members 46 can be similar in construction to the wings 16,16', and, as viewed in the figures, each includes a base portion 48 interconnecting two leg portions 50,52.

As in the case of the wings 16,16', distal ends of the leg portions 50,52 are provided with apertures 54,56, each aperture being registered with one in an opposite leg. Spacing between the legs 50,52 is such that it aproximates the distance between the tabs 20,20' of the binding support 14. As in the case of the wings 16,16', at least one of the legs is resilient so that flexure of the legs toward one another can be effected. The one or more U-shaped members 46 can thereby be mounted to the tangs 22,22' for pivoting thereabout.

Figure 4:
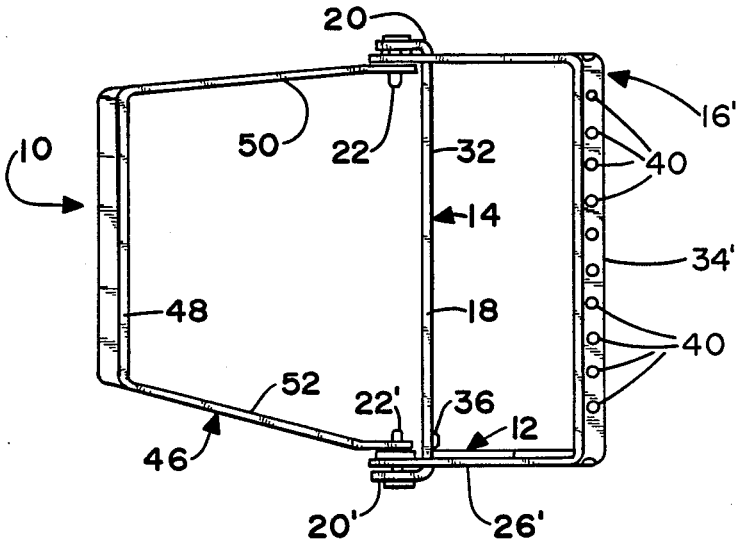
FIG. 4 is a side elevational view of the embodiment illustrated in FIG. 1.

As best seen in FIG. 4, the angles at which the legs 50,52 intersect corresponding base portion 48 can be different. As will understand, therefore, if the member 46 is mated to the binding rest in one orientation, the rest 14 will be maintained at a particular angle relative to a surface on which the support 10 is positioned. If the member or members 46 are inverted, however, the device 10 will be supported at an angle relative to the surface on which the support 10 is positioned which is different.

Figure 5:
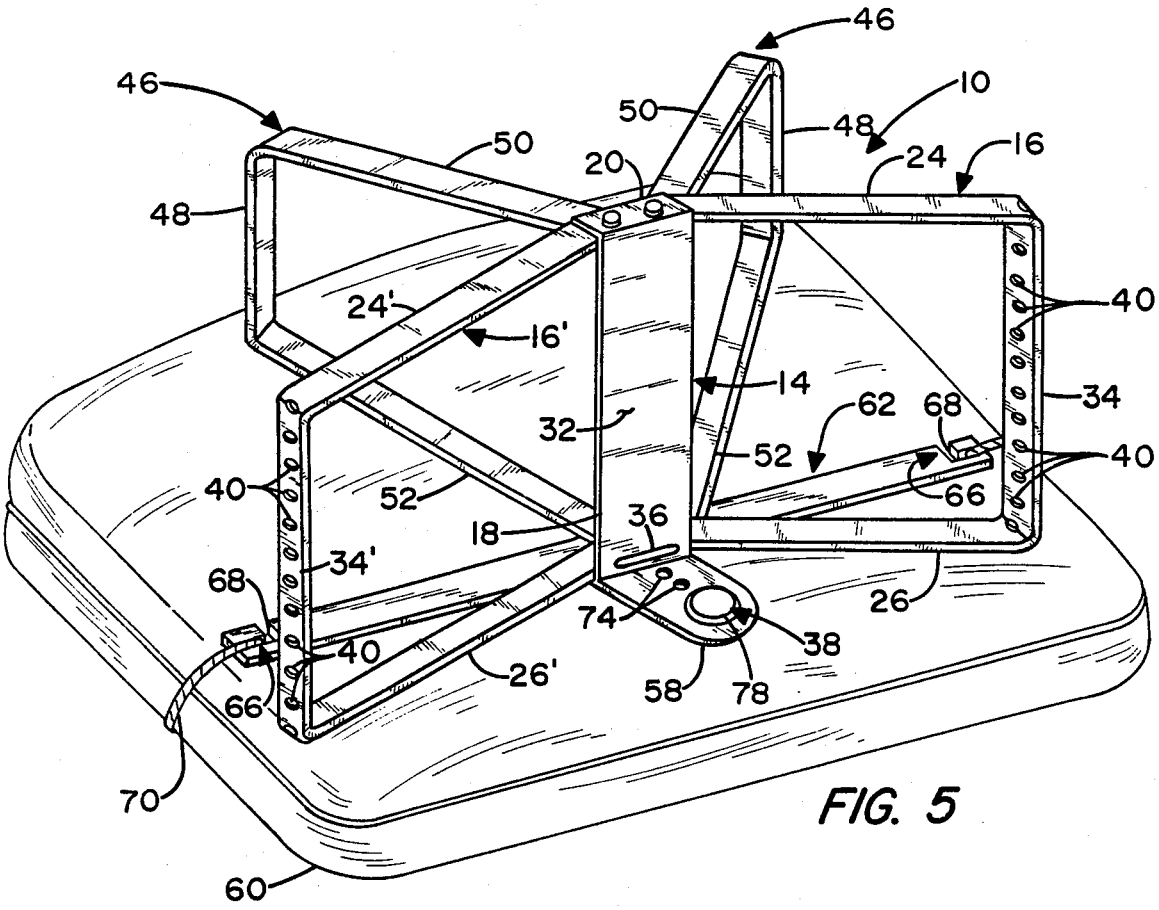
FIG. 5 is a perspective view of an alternative embodiment of the invention as secure to a pillow.
Figure 6:
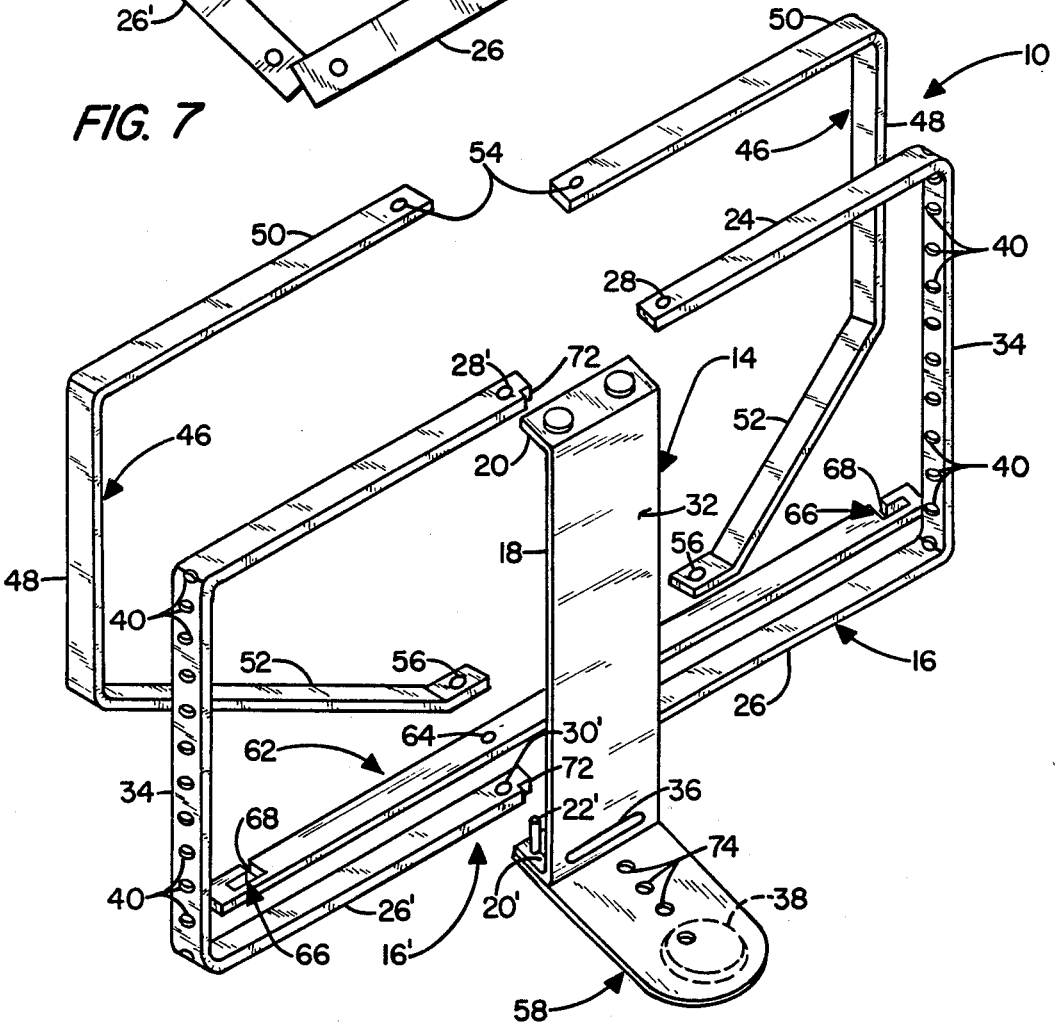
FIG. 6 is an exploded perspective view of the embodiment illustrated in FIG. 5.

FIGS. 5 and 6 illustrate an alternative embodiment employing a different structure for underlying a book that can be held by the support 10. That structure is particularly appropriate for use for reading in bed. The underlying structure takes the form of a tongue 58 which extends from the binding rest 14 at a lower extremity thereof. FIG. 6 shows the tongue 58 wherein a portion of it overlies the lower tab 20' of the rest 14 and is secured thereto in any appropriate manner.

As seen in FIG. 5, the alternative embodiment can, for example, be secured to a pillow 60. A pillow attachment bar 62 is provided for this purpose. The bar 62 has apertures 64 located centrally there along. The apertures 64 are spaced from one another at a distance closely aproximating the distance between the tangs 22' carried by the lower tab 20'. Consequently, the tangs 22' of the lower tab 20' can be "plugged into" the pillow attachment bar 62, and the generally U-shaped orienting members 46 can be attached to the binding rest 14 after the attachment bar 62 has been "plugged into" in order to maintain the bar 62 with the overall assembly.

The bar 62 is provided, at its ends, with 90° slots 66, the distal end of each slot 66 being positioned toward a corresponding end of the bar 62 relative to an entrance channel portions 68. A cord 70, knotted at each end and extended about the pillow 60, can be employed, therefore, for holding the support to the pillow 60. The length of the bar 62 is, typically, shorter than the width of the pillow 60 so that edges of the pillow 60 will tend to urge ends of the cord 70 toward the end of the pillow attachment bar 62. Each end of the cord 70 can, thereby, be knotted and inserted through one of the channels 68 in the end of the pillow attachment bar 62 to a position at which the knot is received at the intermost end of the slot 66 and held therein by the tension exerted on the cord 70 by the fullness of the pillow 60. It will be understood, of course, that the size of a knot in the cord 70 will be greater than a width dimension of the slot 66.

Figure 7:
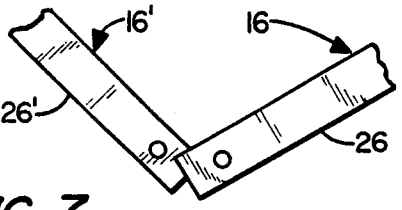
FIG. 7 is a bottom plan view of a section of support wings illustrating structure by which the cover support wings can be locked in an angular position relative to one another.

FIGS. 6 and 7 illustrate a construction of the variable angle wings 16,16' wherein, when they are in desired positions to support the front and back covers of a book, they can be locked with respect to one another. As seen in FIG. 6, distal ends of upper and lower legs 24',26' of one wing 16' can be notched as at 72. Ends of the legs 24,24',26,26' of the wings 16,16' are sufficiently close together so that, normally, they cannot be freely pivoted about their respected axes of pivot. Because of the resiliency of the legs, however, one or both can be flexed so that corresponding legs are non-coplanar. With the legs 24,24',26,26' out of alignment, they can be pivoted about their respective axes until a corner of each of the non-notched legs 24,26 is registered with a corresponding notch 72 in the same leg 24'26' of the opposite wing 16'. The legs can, then, be permitted to return to their normal positions with the registered corners received within corresponding notches 72. Additional relative pivoting of the wings 16,16' will, thereby, be precluded.

The alternative embodiment illustrated in FIGS. 5 and 6, as previously indicated, indicates employment of a flexible tongue 58. Those figures show the tongue 58 having a plurality of spaced apertures 74 formed in the tongue 58 in a linear alignment extending generally perpendicular to the outwardly facing surface 32 of the main body portion 18 of the binding rest 14. Although not essential to the invention, the apertures 74 can take the form of grommets secured in the flexible material.

Figure 8:
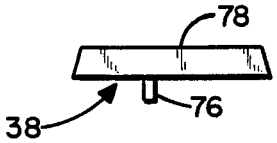
FIG. 8 is a side elevational view of an eccentric which can be mounted to a shelf or flexible tongue underlying the book supported by the invention.

The apertures 74 function to receive a shaft 76 extending from the underside of an eccentric 38, as best illustrated in FIG. 8. As seen in FIG. 8, the eccentric main body 78 can be formed in the shape of a truncated cone.

The eccentric 38 functions to maintain the book open to a particular page without the reader having to manually maintain the page. The particular aperture 74 in which the shaft 76 from the eccentric 38 is received and the particular angular position in which the eccentric 38 is oriented are functions of the thickness of the book. It will be able to be seen, in view of this disclosure, that, for thinner books, the eccentric 38 will be able to be positioned more closely to the binding rest 14 and be rotated so that a greater radius of the eccentric 38 extends toward the rest 14.

The diameter of the shaft 76 extending from the eccentric 38 can, if desired, be made to closely approximate the inside diameter of the aperature 74 in the tongue 58. By so manufacturing the various component parts, the eccentric 38 will be able to be maintained in a particular rotational orientation even when it is subjected to pressures exerted by the pages of the book.

As one may garner, an eccentric 38 is not the only method that can be employed to maintain a book open to a particular page. Other structures are specifically contemplated for accomplishing this function. For example, elastic stays (not shown) extending diagonally across the upper or lower corners (or both) of wings 16,16' can be provided. Pages can be inserted under the stays to hold them open.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A book support, comprising:

(a) a binding rest, engageable by the binding of a book to be supported;

(b) means for orienting said binding rest at a desired angle relative to a surface on which said support rests;

(c) variable angle wings carried by said binding rest and disposed for pivoting about generally parallel axes, each of said wings constraining one of the front and back covers of the book being supported; and (d) means underlying the book to be supported when the binding of the book is in engagement with the binding rest.

2. A support in accordance with claim 1 wherein said binding rest comprises a main body portion and a pair of tabs intersecting said main body portion at spaced locations on said main body portion, each of said tabs carrying a pair of tangs, each of said tangs being axially aligned with a corresponding tang carried by a tab opposite that by which said tang is carried.

3. A support in accordance with claim 2 wherein corresponding tangs project inwardly toward one another from the tabs by which they are carried.

4. A support in accordance with claim 3 wherein two variable angle wings are employed, and wherein each of said wings is generally U-shaped and has registered apertures, one in each of opposed upper and lower legs thereof, formed therein.

5. A support in accordance with claim 4 wherein corresponding tangs are at a defined distance from one another and said generally U-shaped, variable angle wings are resilient so that opposed legs of a wing can be flexed to be brought between corresponding tangs and, thereafter, released to permit each of said corresponding tangs to enter one of said registered apertures, wherein said corresponding tangs define an axis with respect to which a variable angle wing pivots.

6. A support in accordance with claim 3 wherein said orienting means comprises at least one generally U-shaped member including a base portion and a pair of leg portions intersecting said base portion, each of said leg portions having an aperture, registered with an aperture in the other of said leg portions, formed therein.

7. A support in accordance with claim 6 wherein at least one of said leg portions of said generally U-shaped member is resilient and wherein said apertures are spaced at a distance from one another and corresponding tangs are spaced at a distance from one another such that said at least one resilient leg portion can be flexed wherein said leg portions can be brought between corresponding tangs, and said at least one resilient leg portion, thereafter, released to permit each of said corresponding tangs to enter one of said registered apertures.

8. A support in accordance with claim 7 wherein said leg portions intersect said base portion at different angles, wherein said generally U-shaped member can be inverted with respect to said binding rest to vary the angle at which said binding rest is oriented relative to the surface on which said support rests.

9. A support in accordance with claim 2 wherein said tabs intersect said main body portion of said binding rest substantially at right angles.

10. A support in accordance with claim 1 wherein said variable angle wings each comprise:

(a) an upper leg;

(b) a lower leg; and (c) a brace interconnecting said upper and lower legs to form an integral wing defining a common plane.

11. A support in accordance with claim 10 wherein said binding rest has a forwardly facing surface, and wherein said variable angle wings pivot to locations forward of said forwardly facing surface.

12. A support in accordance with claim 11 wherein two variable angle wings, one on either side of said binding rest, are employed, and wherein said underlying means comprises a shelf, seated on said lower legs of said wings, wedged between said binding rest and said interconnecting braces of said wings.

13. A support in accordance with claim 12 further comprising means for maintaining said shelf in a position seated on said lower legs of said wings.

14. A support in accordance with claim 13 wherein said maintaining means comprises a bead formed on said forwardly facing surface of said binding rest, said bead engaging an upper surface of said shelf when said shelf is seated on said lower legs of said wings.

15. A support in accordance with claim 12 further including an eccentric rotatably disposed on an upper surface of said shelf to engage pages of a book supported thereon and preclude closure of the book.

16. A support in accordance with claim 1 wherein said underlying means comprises a flexible tongue extending forwardly from said binding rest proximate a lower end of said rest and an eccentric rotatably disposed on an upper surface of said tongue to engage pages of a book supported thereon and preclude closure of the book.

* * * * *